US006742369B1

(12) United States Patent
Veillette

(10) Patent No.: US 6,742,369 B1
(45) Date of Patent: Jun. 1, 2004

(54) AUXILIARY DOOR LOCK

(76) Inventor: Pierre Veillette, 6-41 Georges Bilodeau, Hull, Quebec (CA), J8Z 1T1

( * ) Notice: Subject to any disclaimer, the term of this patent is extended or adjusted under 35 U.S.C. 154(b) by 0 days.

(21) Appl. No.: 10/352,982

(22) Filed: Jan. 29, 2003

(51) Int. Cl.[7] ..... E05B 13/00
(52) U.S. Cl. ..... 70/416; 70/211; 292/288
(58) Field of Search ..... 70/416, 419, 210, 70/211; 292/347, 288, 289, DIG. 2

(56) References Cited

U.S. PATENT DOCUMENTS

| | | | | | |
|---|---|---|---|---|---|
| 1,700,135 | A | * | 1/1929 | Lanes | 70/416 |
| 2,463,195 | A | * | 3/1949 | Mungan | 70/416 |
| 3,263,462 | A | * | 8/1966 | Suroff et al. | 70/416 X |
| 3,264,850 | A | * | 8/1966 | Bower | 70/416 X |
| 3,423,974 | A | * | 1/1969 | Bernsley | 70/416 |
| 3,748,882 | A | * | 7/1973 | Dusault et al. | 70/416 |
| 4,064,721 | A | * | 12/1977 | Morgan | 70/416 |
| 4,279,137 | A | * | 7/1981 | Cook | 70/416 |
| 4,404,826 | A | * | 9/1983 | Brill | 70/416 |
| 4,673,202 | A | * | 6/1987 | Willis | 292/162 |
| 4,827,745 | A | * | 5/1989 | Baugh | 70/416 |
| 4,869,086 | A | * | 9/1989 | Richards | 70/416 |
| 5,000,498 | A | * | 3/1991 | Upchurch | 292/288 |
| 5,003,803 | A | * | 4/1991 | Richards | 70/416 |
| 5,007,263 | A | * | 4/1991 | Taylor | 70/416 |
| 5,035,128 | A | * | 7/1991 | Ridgway | 70/211 |
| 5,052,202 | A | * | 10/1991 | Murphy | 70/211 |
| 5,067,334 | A | * | 11/1991 | Sorkilmo | 70/416 |
| 5,193,373 | A | * | 3/1993 | Hunt | 70/416 |
| 5,313,812 | A | * | 5/1994 | Eklund et al. | 70/416 |
| 5,369,971 | A | * | 12/1994 | Sheppard | 70/416 |
| 5,423,583 | A | * | 6/1995 | Crockom | 292/289 |
| 5,515,704 | A | * | 5/1996 | van Nguyen | 70/416 |
| 5,651,279 | A | * | 7/1997 | Berton et al. | 70/211 |
| 5,934,122 | A | * | 8/1999 | Edwards et al. | 70/416 |
| 5,950,465 | A | * | 9/1999 | Schultz et al. | 70/416 |
| 6,105,406 | A | * | 8/2000 | Thompson et al. | 70/416 |
| 6,301,941 | B1 | * | 10/2001 | Nicholsfigueiredo | 70/211 |
| 6,324,879 | B1 | * | 12/2001 | Kennedy | 70/416 |

* cited by examiner

*Primary Examiner*—Suzanne Barrett
(74) *Attorney, Agent, or Firm*—George A. Seaby

(57) ABSTRACT

An auxiliary door lock for a dead bolt lock includes a relatively flat rectangular housing for mounting on a door over the interior operating knob of the dead bolt lock; and an actuator slidable and rotatable in an opening in a front wall of the housing. The actuator includes a hollow handle, which is used to rotate the knob. Teeth on the actuator mesh with teeth in the housing in one position of the actuator so that the latter and the knob cannot be rotated when the door is locked. Thus, even using a key, someone outside of the door cannot unlock the dead bolt lock. By pushing the actuator into the housing to a second position, the teeth are disengaged and the actuator can be rotated to unlock the dead bolt lock.

6 Claims, 5 Drawing Sheets

AUXILIARY DOOR LOCK

BACKGROUND OF THE INVENTION

1. Field of the Invention

This invention relates to an auxiliary door lock, and in particular to an auxiliary lock for use on the interior operating knob of a dead bolt lock.

2. Discussion of the Prior Art

There are tens of millions of dead bolt locks currently in use in North America. Such locks include a retractable bolt which is operated using a knob on the interior of a door, or using a key in an exterior portion of the lock. All too often, duplicates of keys for operating the locks from the outside of a dwelling fall into the wrong hands. Because of this problem, auxiliary locks for use with dead bolt locks have long been in existence. Examples of such auxiliary locks are found in Canadian Patent No. 2,054,078, which issued to S. P. Meszaros on Dec. 9, 1997; Canadian Patent Application 2,310,971, laid open on Mar. 22, 2001; and U.S. Pat. No. 2,463,195, which issued to P. F. Mungan on Mar. 1, 1949; U.S. Pat. No. 3,748,882, which issued to R. A. Dusault, Jr. et al on Jul. 31, 1973; U.S. Pat. No. 5,901,590, which issued to C. I. Lai on May 11, 1999; U.S. Pat. No. 5,934,122, which issued to T. M. Edwards et al on Aug. 10, 1999; U.S. Pat. No. 6,105,406, which issued to S. G. Thompson et al on Aug. 22, 2000; U.S. Pat. No. 6,145,358, which issued to W.-B. Wu on Nov. 14, 2000 and U.S. Pat. No. 6,301,941, which issued to M. L. Nicholsfigueiredo on Oct. 16, 2001.

Many of the patented devices are somewhat complicated and hence expensive to manufacture and/or difficult to install and operate. Accordingly, there is still room for improvement of auxiliary locks of the type in question.

GENERAL DESCRIPTION OF THE INVENTION

The object of the present invention is to meet the above defined need by providing a relatively simple auxiliary lock for use with a dead bolt lock which is easy to manufacture, install and operate.

Accordingly, the present invention involves an auxiliary lock for use on the interior operating knob of an exterior key-operated dead bolt lock comprising:

(a) housing means for mounting on the inside of a door over the operating knob of a dead bolt lock;

(b) an opening in said housing means;

(c) actuator means for slidable mounting in said opening and on the knob of a dead bolt lock;

(d) first teeth means in said housing means; and (e) second teeth means on said actuator means for cooperating with said first teeth means to lock said operating lock in a locked position, whereby, when the actuator means is in a first, unlocked position in the housing means, the dead bolt lock knob cannot be rotated to unlock the door, and when the actuator means is in a second, unlocked position in the housing means, the actuator means and the operating knob can be rotated to unlock the door.

BRIEF DESCRIPTION OF THE DRAWINGS

The invention is described below in greater detail with reference to the accompanying drawings, which illustrate a preferred embodiment of the invention, and wherein.

DESCRIPTION OF THE PREFERRED EMBODIMENT

In this description, the terms "front" and "rear" are used to describe parts of elements of the lock as they would appear when mounted on a door.

Figure 1:
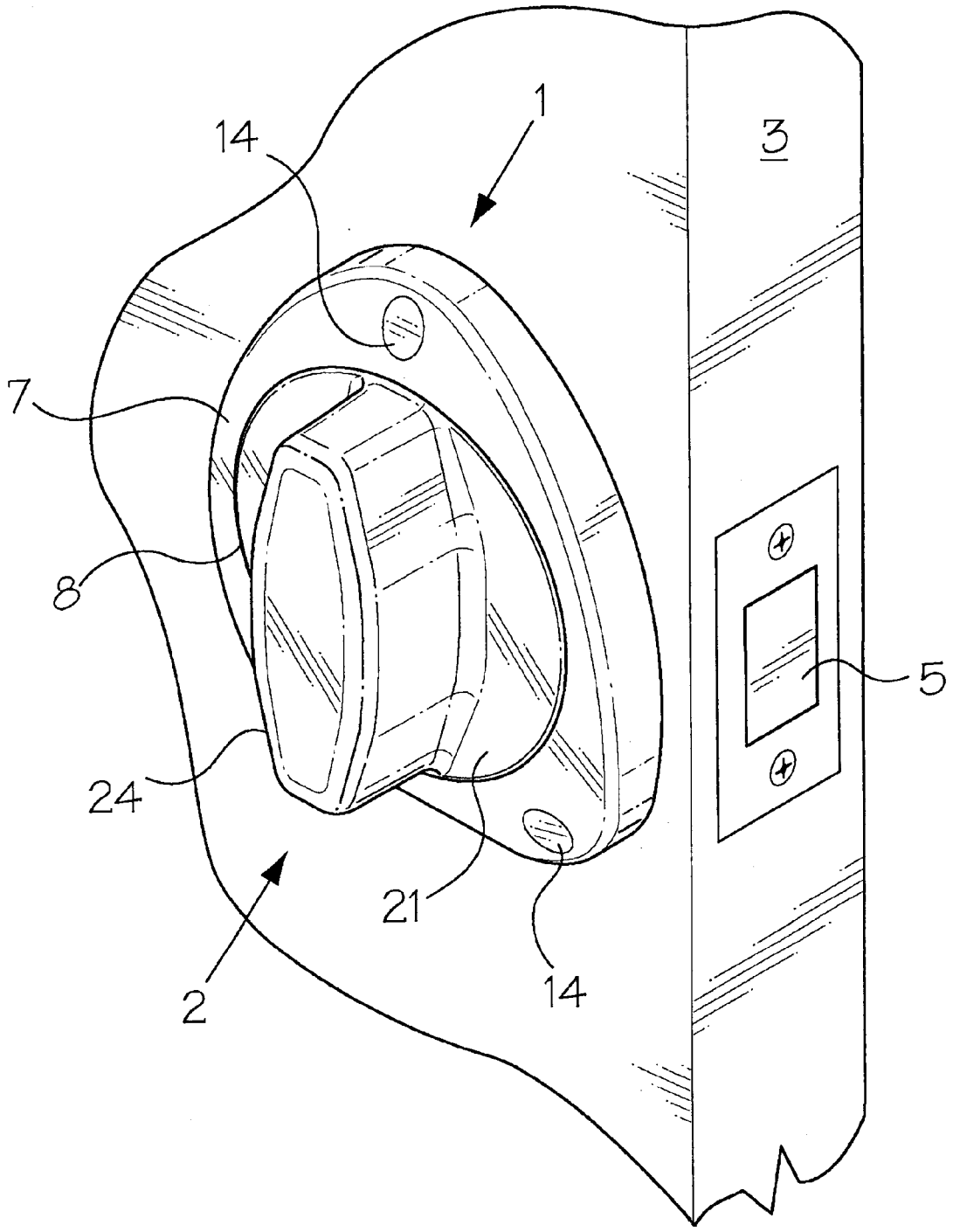
FIG. 1 is an isometric view of an auxiliary door lock in accordance with the invention and a section of door containing a bolt lock.
Figure 2:
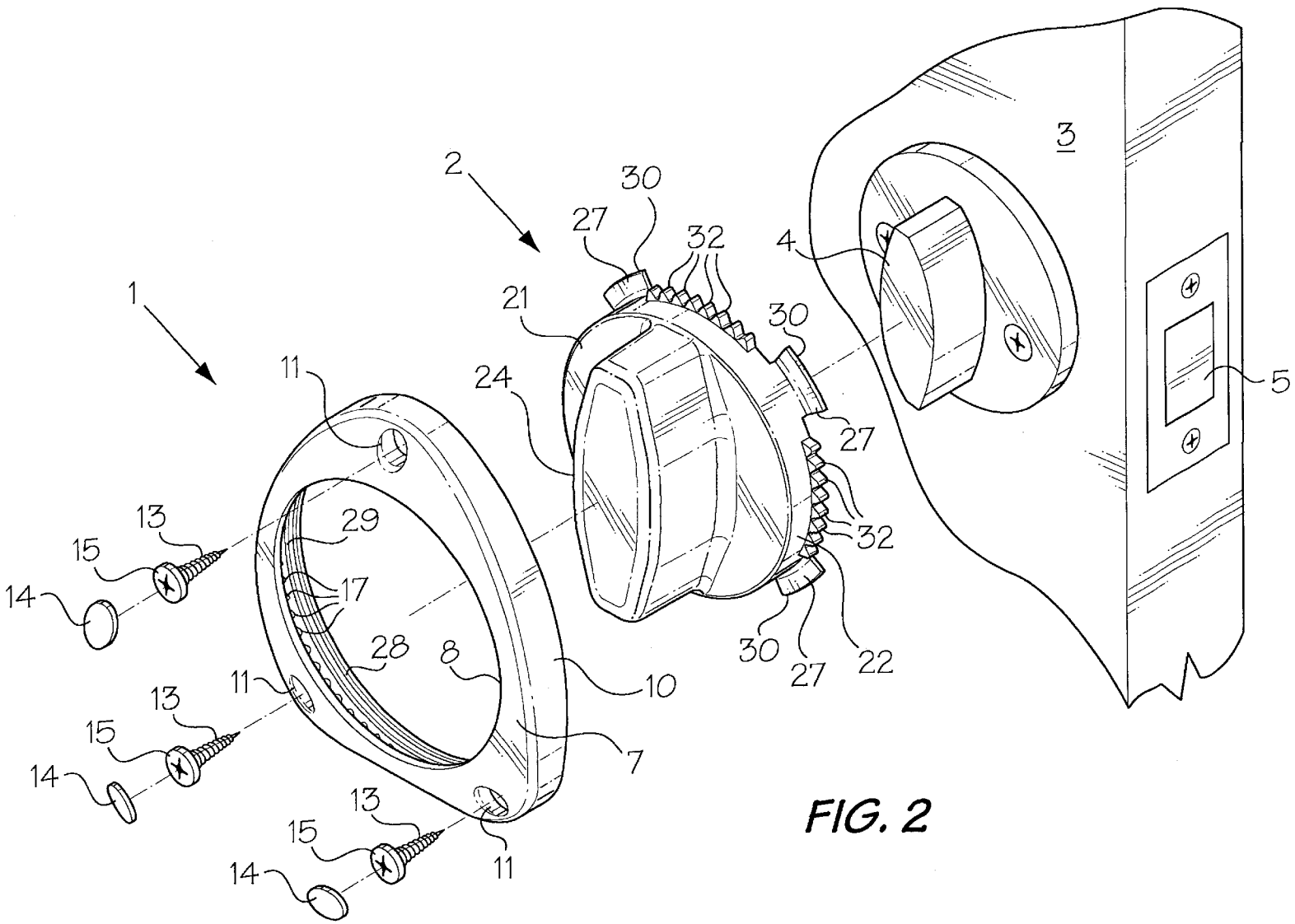
FIG. 2 is an exploded, isometric view of the auxiliary lock of FIG. 1.

Referring to FIGS. 1 and 2, the principal elements of the auxiliary lock of the present invention are a housing and an actuator indicated generally at 1 and 2, respectively. The elements are mounted on the inside of a door 3 to cover the knob 4 of a dead bolt lock to selectively allow or prevent rotation of the knob 4 when a key (not shown) is inserted into the lock from the outside and an attempt is made to rotate the lock between the open and closed positions.

Figure 3:
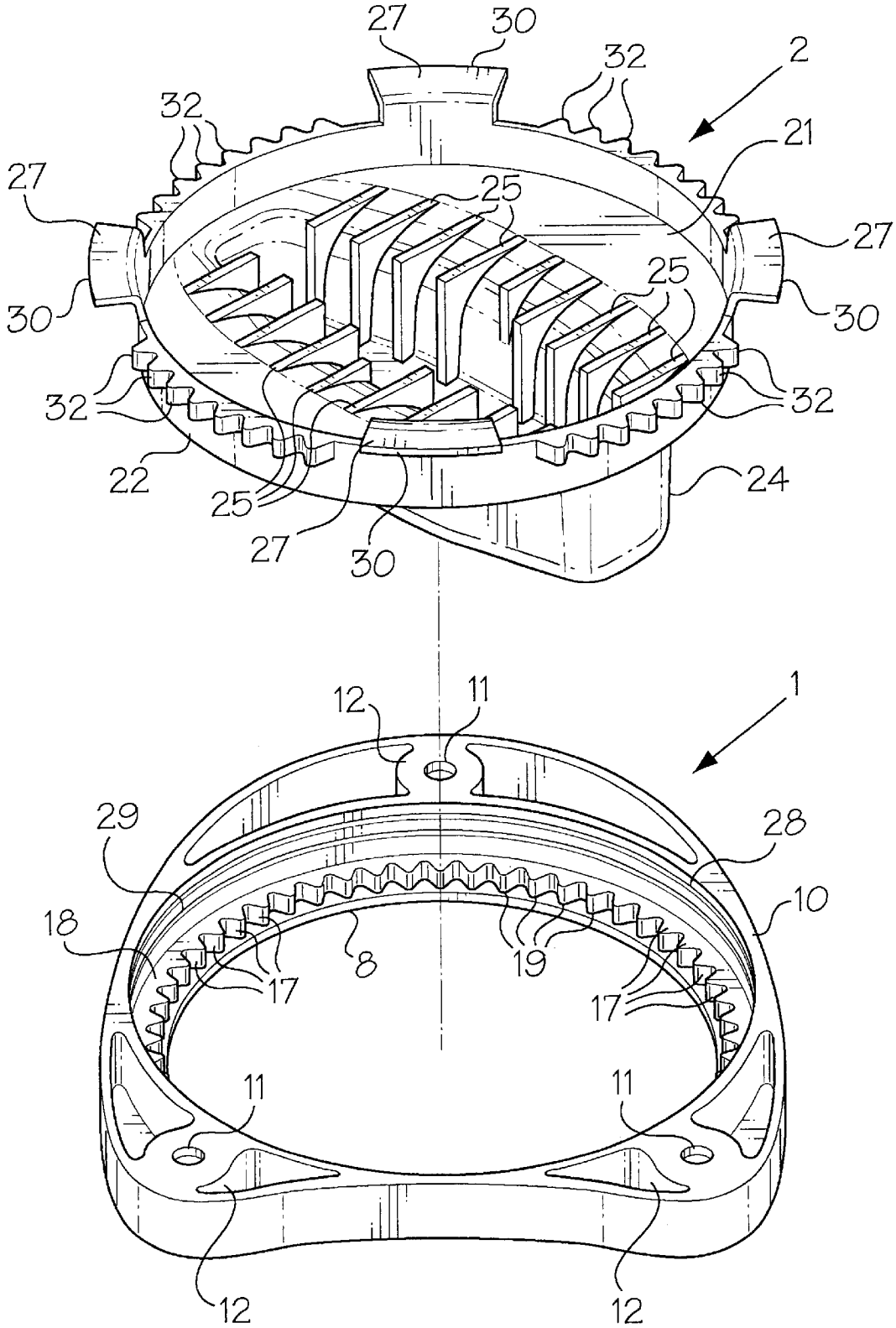
FIG. 3 is an isometric, exploded view of an actuator and a housing used in the auxiliary lock of FIGS. 1 and 2, as seen from the rear thereof.

As best shown in FIGS. 2 and 3, the housing 1 includes a generally triangular front wall 7 with a large circular opening 8 therein, and a side wall 10 extending around the outer periphery of the front wall 7. While the housing 1 is generally triangular with convex sides and a concave bottom (as seen when mounted on a door), it will be appreciated that the housing design is a matter of aesthetics and does not affect the operation of the lock. Countersunk holes 11 are provided in reinforcing ribs 12 near the corners of the housing 1 for receiving screws 13 for mounting the housing 1 on the door 3. Once the housing 1 has been mounted on a door 3, plugs 14 are placed in the holes 11 to cover the heads 15 of the screws 13 and to close the holes 11.

Figure 4:
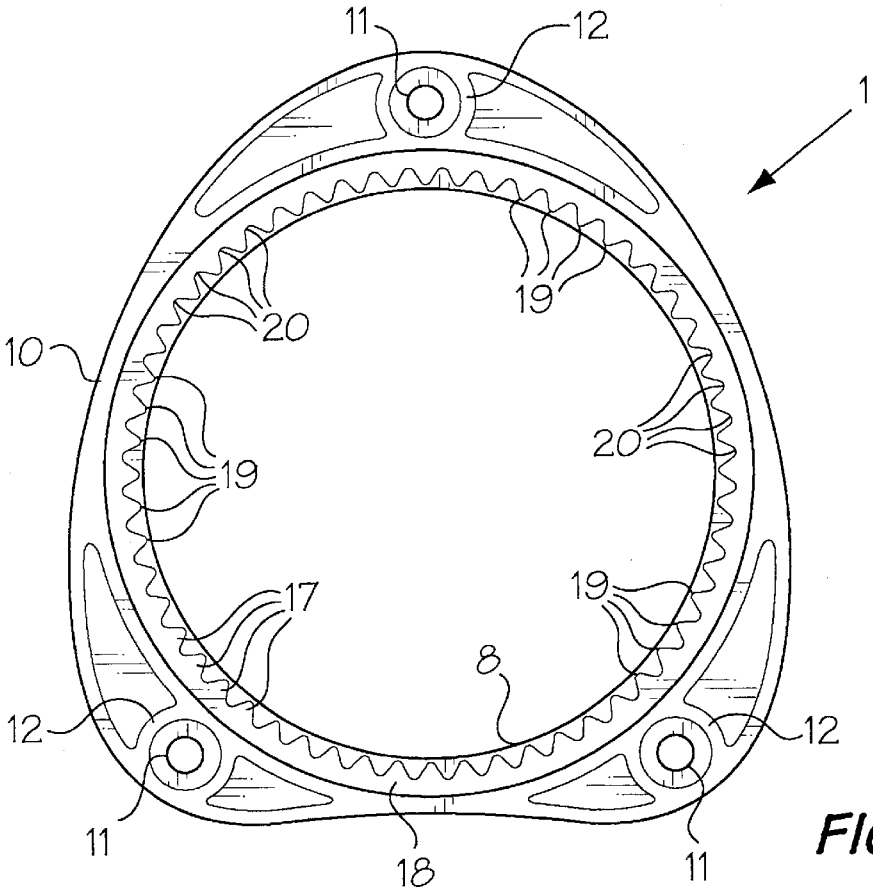
FIG. 4 is a rear view of the housing of FIG. 3.
Figure 5:
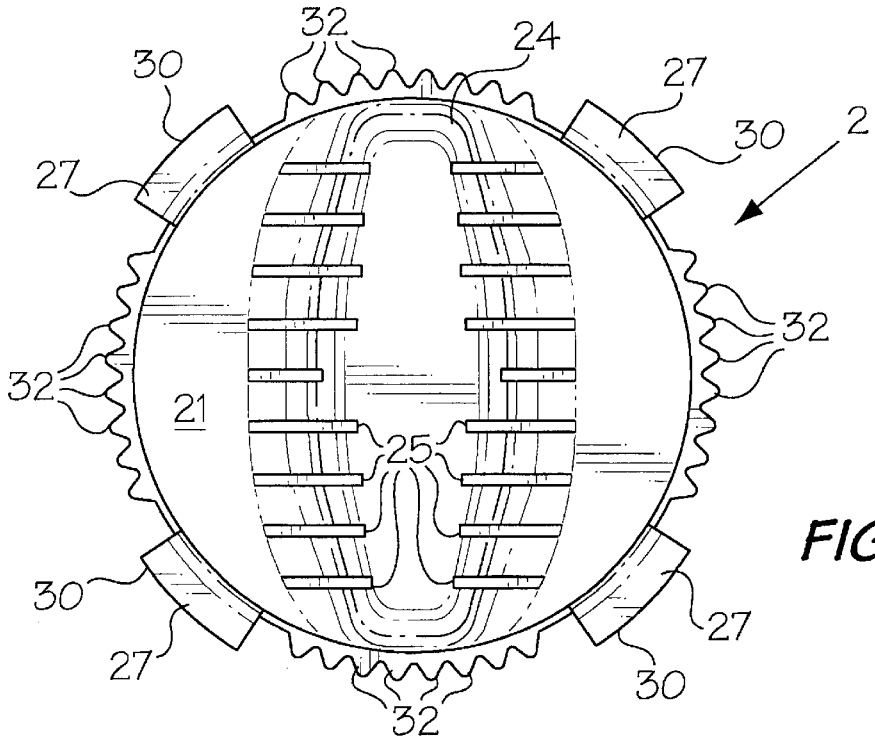
FIG. 5 is a rear view of the actuator of FIG. 3.

A circular row of radially inwardly extending teeth 17 is provided on a shoulder 18 immediately inside of the opening 8. A circle connecting the inner tips 19 (FIGS. 3 and 4) of the teeth 17 is slightly larger in diameter than the opening 8, so that the teeth 1 do not interfere with rotation of the circular actuator 2 in the opening 8. The teeth 19 alternate with V-shaped notches 20.

The actuator 2 is defined by a circular front or outer wall 21 and an annular side wall 22 integral therewith. The outer diameter of the side wall 22 is only slightly smaller than the diameter of the opening 8, so that the actuator 2 is freely rotatable and slidable in the housing 1. A large, hollow, roughly hexagonal handle 24 extends outwardly from the front wall 21 of the actuator 2 for manually rotating the actuator in the housing 1. A plurality of opposed square cross section ribs 25 extend inwardly from the inner sides of the hollow handle 24 for accommodating lock knobs 4 of different sizes and shapes. The inner free ends of various ribs 25 can be removed using, e.g. wire cutters or a knife, so that when the handle 24 is slid onto a knob 4, there is a reasonably snug fit between the two The actuator 2 is slid into the housing 1 through the open rear end thereof so that the handle 24 extends outwardly through the opening 8. The actuator 2 is releasably retained in one of two positions by four resilient arms 27, which are spaced equidistant apart, and which extend outwardly from the inner free edge of the actuator side wall 22 into one of two parallel, spaced apart, annular grooves 28 and 29 in the inner surface of the housing side wall 20. The arms 27 are L-shaped in cross section, and include arcuate outer free ends 30 with the same curvature as the grooves 28 and 29. The distance between the outer free ends 30 of each pair of diametrically opposed arms is the same as the diameter of the housing side walls 10 at the bottoms or outer peripheries of the grooves 28 and 29. As mentioned above, the arms 27 are resilient so that when the actuator 2 is pushed or pulled axially of the housing 1, the arms 27 are released by one groove 28 or 29 and then snap into the other groove. Snapping of the arms 27 into one of the grooves 28 and 29 provides an indication that the actuator 2 is in the release position or in the locking position. When the arms 27 are in the groove 28, the front wall 21 of the actuator 2 is more or less flush with the front wall 7 of the housing 1, and when the arms 29 are in the groove 28, the side wall 22 of the actuator 2 sticks out of the housing 1 (FIG. 6).

In the locking position of the actuator 2, i.e. when the arms 27 are in the groove 29, arcuate rows of teeth 32 on the inner or rear free edge of the side wall 22 between the arms 27 mate with the teeth 17 in the housing 1. A circle through the outer tips of the teeth 32 is only slightly smaller in diameter than a circle through the outer, narrow ends of the V-shaped notches 20 between the teeth 17 in the housing 1 so that the teeth 32 can slide into such notches 20. However, when the teeth 17 mesh with the teeth 32, the actuator 2 cannot be rotated relative to the housing 1.

Figure 6:
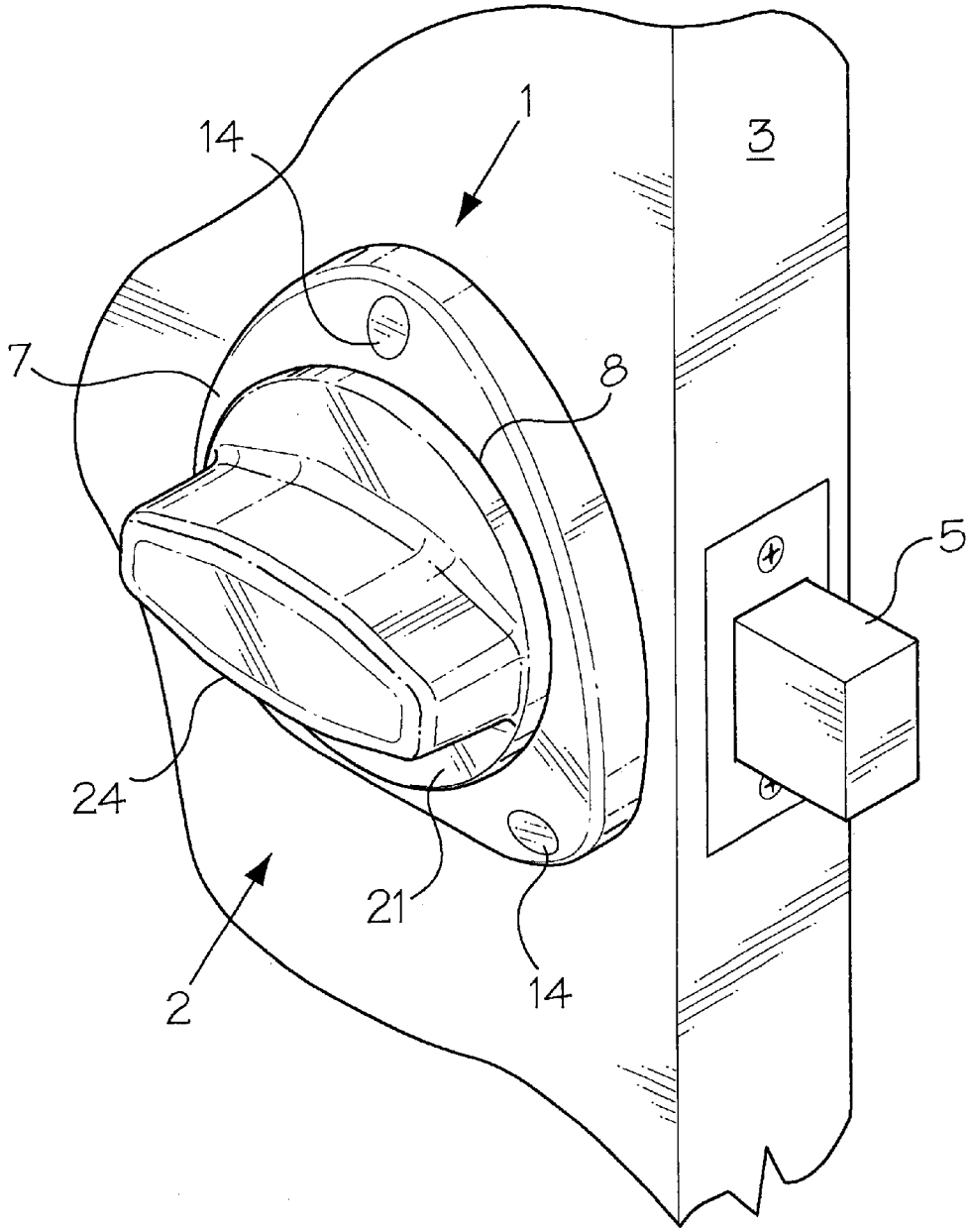
FIG. 6 is an isometric view of the door lock of FIG. 1 in the locked condition.

Referring to FIG. 6, when assembling the auxiliary lock on a door 3 the actuator 2 placed on the knob 4 of the dead bolt lock with the latter in the locked condition, i.e. with the bolt 5 extended. If necessary, the inner, free ends of selected of the opposed ribs 25 are cut so that the handle 24 fits snugly, but slidably over the knob 4 of the dead bolt lock The housing 1 is slid onto the actuator 2 until the free ends of the arms 27 snap into the groove 29. In this position, the teeth 17 with the teeth 32, and the actuator cannot be rotated. The housing 1 is then secured to the door 3 using the screws 13. The bolt 5 cannot be retracted to the unlocked position using a key on the outside of the closed and locked door. In order to retract the bolt 5, i.e. to unlock the dead bolt lock, the actuator 2 is pushed into the housing 1 to move the arms 27 into the groove 28. The teeth 32 are no longer meshing with the teeth 17, and the knob 4 can be rotated with the handle 24 to unlock the dead bolt lock.

I claim:

1. An auxiliary lock for use on an interior operating knob of an exterior key-operated dead bolt lock comprising:

(a) a housing for mounting on the inside of a door over an operating knob of a dead bolt, said housing including:
  (i) a front wall;
  (ii) a side wall;
  (iii) an open rear end;
  (iv) a circular opening in said front wall; and
  (v) first teeth on said side wall extending radially inwardly towards said opening; and (b) an actuator for slidable and rotatable mounting in said opening in the housing including:
  (i) a circular outer wall;
  (ii) a hollow handle extending outwardly from said circular outer wall for mounting the actuator on an interior operating knob;
  (iii) an annular side wall; and
  (iv) a plurality of second teeth extending radially outwardly from a free end of said annular side wall for slidable meshing with said first teeth of said housing, whereby, when the housing is mounted on a door with the actuator on the operating knob and the actuator is pulled toward the front wall of the housing so that the first and second teeth are meshing, the actuator and knob cannot be rotated to unlock the door, and, when the actuator is pushed toward the door so that the first and second teeth no longer mesh, the actuator is free to rotate in the housing to unlock the door.

2. The auxiliary lock of claim 1, including resilient arm means on said actuator; and groove means in said housing for receiving said arm means to releasably lock said actuator in the locked or unlocked position.

3. The auxiliary lock of claim 2, wherein said actuator includes rib means in said handle for gripping the sides of an operating knob, whereby portions of the rib means can be removed to adapt the handle to a variety of dead bolt lock knobs.

4. An auxiliary lock for use on an interior operating knob of an exterior key-operated dead bolt lock comprising:

(a) a housing for mounting on the inside of a door over an operating knob of a dead bolt, said housing including:
  (i) a front wall;
  (ii) a side wall;
  (iii) an open rear end;
  (iv) a circular opening in said front wall;
  (v) an annular shoulder on an interior surface of said front wall around said opening, and
  (vi) first teeth on said shoulder extending radially inwardly towards said opening; and (b) an actuator for slidable and rotatable mounting in said opening in the housing including:
  (i) a circular outer wall;
  (ii) a hollow handle extending outwardly from said circular outer wall for mounting the actuator on an interior operating knob;
  (iii) an annular side wall; and
  (iv) a plurality of second teeth extending radially outwardly from a free end of said annular side wall for slidable meshing with said first teeth of said housing, whereby, when the housing Is mounted on a door with the actuator on the operating knob and the actuator is pulled toward the front wall of the housing so that the first and second teeth are meshing, the actuator and knob cannot be rotated to unlock the door, and, when the actuator is pushed toward the door so that the first and second teeth no longer mesh, the actuator is free to rotate in the housing to unlock the door.

5. The auxiliary lock of claim 4, including resilient arms extending radially outwardly from the annular side wall of said actuator; and annular grooves in said housing side wall for receiving said arms to releasably lock the actuator in a locked or unlocked position.

6. The auxiliary lock of claim 5, wherein said second teeth are in arcuate rows alternating with said resilient arms around and extending radially outwardly from said free end of the annular side wall of the actuator.

* * * * *